United States Patent [19]

Zwierzelewski

[11] 4,455,988

[45] Jun. 26, 1984

[54] FUEL ECONOMIZER

[76] Inventor: Victor F. Zwierzelewski, 3870 Kiefer, Warden, Mich. 48091

[21] Appl. No.: 336,104

[22] Filed: Dec. 30, 1981

[51] Int. Cl.[3] ..... F02M 29/00

[52] U.S. Cl. ..... 123/590; 123/308; 123/432; 123/52 M; 48/180 R

[58] Field of Search ..... 123/590, 591, 308, 432, 123/52 M, 52 MB; 261/DIG. 21, DIG. 55, 79 R; 48/180 R, 180 B

[56] References Cited

U.S. PATENT DOCUMENTS

| | | | |
|---|---|---|---|
| 1,159,985 | 11/1915 | Orlopp | 123/52 M |
| 1,801,446 | 4/1931 | Muhr | 123/592 |
| 2,298,563 | 10/1942 | Hersch | 48/180 R |
| 2,727,502 | 12/1955 | Grillet et al. | 123/52 M |
| 3,364,911 | 1/1968 | Baudry et al. | 123/575 |
| 3,618,577 | 11/1971 | Shaw | 123/590 |
| 3,678,905 | 7/1972 | Diehl | 123/52 M |
| 3,918,423 | 11/1975 | Amor | 123/590 |
| 3,931,811 | 1/1976 | McFarland, Jr. | 123/52 M |
| 3,943,900 | 3/1976 | Primrose | 125/590 |
| 3,966,430 | 6/1976 | Stephens | 123/590 |
| 3,998,195 | 12/1976 | Scott | 123/52 M |
| 4,064,850 | 12/1977 | Nakagawa et al. | 123/274 |
| 4,078,532 | 3/1978 | Smith | 123/590 |
| 4,109,620 | 8/1978 | Webb | 123/52 M |
| 4,196,701 | 4/1980 | Tamura et al. | 123/308 |
| 4,262,639 | 4/1981 | Motosugi et al. | 123/52 MB |

*Primary Examiner*—Charles J. Myhre
*Assistant Examiner*—E. Rollins Cross
*Attorney, Agent, or Firm*—Remy J. VanOphem

[57] ABSTRACT

A fuel economizer device for use with an internal combustion engine fitted with a carburetor is disclosed. The fuel economizer includes a plate member which is mounted between the carburetor and the intake portion of the intake manifold. The plate member further has at least one aperture formed therein. One tube is inserted through the at least one aperture in the plate member. The one tube extends longitudinally in the passage of the intake manifold from the intake portion toward the exit portion thereof. The one tube concentrates the mixture of fuel and air from the carburetor and conveys the mixture of fuel and air to a point adjacent but spaced away from the inlet port of the internal combustion engine.

19 Claims, 5 Drawing Figures

FUEL ECONOMIZER

FIELD OF THE INVENTION

This invention relates to fuel economizer devices and more particularly to a fuel economizer device that is to be used with a carbureted internal combustion engine.

BACKGROUND OF THE INVENTION

The United States consumes approximately 30% of the world's annual energy supplies. About 93% of our energy requirements are provided by fossil fuels, of which nearly half are from crude oil sources. Since crude oil production in the United States has been falling off since reaching a peak in 1972–1973, most of our crude oil supplies come largely from the Middle East. Recent events in the Middle East have sharply focused our attention to our overdependence on foreign oil supplies. Thus, until we can develop alternate energy sources, our attention has focused on fuel conservation and reducing our enormous appetite for crude oil.

One of the largest users of crude oil sources in the United States is the automobile. Because of this, heavy consideration is being given to increase the efficiency of fuel usage of internal combustion engines.

Automobiles are generally powered by either one of two types of internal combustion engines, that is, spark ignition or compression ignition. By far the most popular is the spark ignition engine which generally employs a carburetor to atomize and mix the fuel with air flowing into the engine. The carburetor is usually mounted on an intake manifold. The intake manifold distributes the fuel/air mixture produced by the carburetor into the combustion chambers of the engine. The fuel/air mixture from the carburetor is drawn into the combustion chambers of the engine by a vacuum created in the intake manifold by reciprocating movement of the pistons during the "suction stroke" of each cylinder of the internal combustion engine.

In a typical V-8 engine there are eight passages in the intake manifold which connect a plenum chamber formed at the inlet of the intake manifold and located below the carburetor, into each of the eight cylinders of the internal combustion engine. In each of the cylinders of the internal combustion engine, the fuel/air mixture from the carburetor is then compressed, ignited by means of a spark plug and the resulting combustion of the fuel/air mixture creates "a power stroke" on the piston. The power stroke on the piston causes the crankshaft to receive a power force which is then transmitted mechanically to the wheels of the vehicle.

One major problem with carbureted internal combustion engines is that a carburetor produces a mixture of air and vaporized fuel, atomized fuel, and liquid fuel. This, in turn, makes it difficult, if not impossible, to provide a uniform fuel/air mixture through the intake manifold into each of the cylinders of the internal combustion engine. For example, the atomized fuel, consisting of very fine particles of fuel suspended in air, has a tendency to come out of suspension when the fuel/air mixture goes through the turns in the passages of the intake manifold. Liquid fuel, which is not suspended in the air, travels along the walls of the passages of the intake manifold toward the inlet port of the cylinder. This non-uniform fuel/air mixture produces a "rich" fuel/air mixture for some of the cylinders of the engine and causes at least one or more of the cylinders to have a "lean" fuel/air mixture. To provide satisfactory engine performance, the usual practice is to richen up the overall fuel/air mixture from the carburetor so as to richen up the "lean" cylinders. This practice, of course, increases the fuel consumption of the internal combustion engine.

There are several known devices intended to provide improved fuel economy for internal combustion engines. In U.S. Pat. No. 3,943,900 issued Mar. 16, 1976 to Ulysses Lee Primrose, a generally thin and flat plate like member having appropriate passages so as to enable it to be bolted to an intake manifold below a carburetor is disclosed. Air is injected at a point within the intake manifold to enable the mixture of air injected there at to disperse in the manifold air stream. The air which is injected into the manifold then is mixed with the fuel/air mixture from the carburetor and provides a leaning of the overall fuel/air mixture to the internal combustion engine. This device is complex and does not concentrate the fuel/air mixture toward the combustion chambers of the engine.

Alfred E. Scott, in U.S. Pat. No. 3,998,195, issued on Dec. 21, 1976, discloses a flow control and vaporizing chamber which is positioned between the carburetor and the intake manifold. The chamber includes a cylindrical member containing a plurality of closely spaced, longitudinally extending tubes. The longitudinally extending tubes receive the fuel/air mixture from the carburetor so as to break up the fuel in the mixture and vaporize the fuel and direct the mixture to the cylinders of the engine. This device thus serves to break down the raw fuel into minute particles thereby further atomizing the fuel droplets. This device is also complex and does not concentrate the fuel/air mixture.

In U.S. Pat. No. 4,078,532, issued to Joseph A. Smith on Mar. 14, 1978, a device adapted to be placed between the carburetor and the intake manifold is disclosed. The device includes a plate member having a plurality of spaced apertures for treating the fuel/air mixture from the carburetor so as to substantially vaporize the fuel prior to entry of the fuel into the intake manifold for distribution to the combustion chambers of the engine. This device is again complex and does not concentrate the fuel/air mixture toward the combustion chambers of the engine.

Stephens, in U.S. Pat. No. 3,966,430, issued June 29, 1976, also discloses a fuel economizer device which is inserted between the carburetor and intake manifold of an internal combustion engine. This device utilizes one or more solid conical members having a series of axial and semi-radially directed apertures. The fuel/air mixture leaving the carburetor is forced into the apertures in the conical member so as to increase the turbulence and homogenization of the fuel/air mixture before being introduced into the engine. This device is, however, complex and expensive to fabricate and does not concentrate the fuel/air mixture toward the combustion chamber of the engine.

Another fuel economizer device is disclosed in U.S. Pat. No. 4,109,620, to George M. Weff, issued on Aug. 29, 1978. This fuel economizer device is adapted for mounting within the throat of an intake passageway of a conventional intake manifold. This fuel economizer device includes a cylindrical sleeve and an annular lip at the top of the sleeve to engage the top of the intake manifold. The device is sandwiched between the intake manifold and a conventional carburetor. The device is also formed with an elliptical shaped deflector partition to deflect fuel/air mixture from the carburetor to the intake manifold. This device, however, does not seek to enhance the fuel/air mixture from the carburetor nor does it concentrate the fuel/air mixture to a point near the intake valve. Therefore, this device has not been found to be widely used in practice.

Finally, U.S. Pat. No. 4,123,996, issued Nov. 7, 1978 to Gillbrand et al, discloses a complex scheme for injecting fuel into the intake manifold of an internal combustion engine. This device controls both the time in which the fuel/air mixture is ignited and the volume of the fuel/air mixture drawn into the engine. The volume of the fuel/air mixture drawn is regulated by a fixed constriction in the inlet passage of the engine. The fuel is injected into the inlet passage by fuel injection valves in response to a control system. This device is not suitable for use with engines fitted with carburetors and is expensive and complicated to make.

None of the aforementioned devices concentrates the fuel/air mixture from the carburetor to a point adjacent but spaced away from the intake valve for each cylinder of the engine in order to provide improved fuel economy for spark ignition engine. In addition, none of the aforementioned devices have been widely used in practice or are simple and inexpensive to make and install in the engine.

SUMMARY OF THE INVENTION

The present invention provides a fuel economy device for use with a carbureted internal combustion engine which concentrates fuel/air mixture from the carburetor to the cylinders of the engine. In addition, the device conveys a concentrated fuel/air mixture to a point adjacent but spaced away from the intake valve of each cylinder of the engine in order to improve the fuel economy of the internal combustion engine.

The present invention is directed to a fuel economizer device for use with internal combustion engines. The internal combustion engine has an inlet port, an intake manifold mounted adjacent to the inlet port, and a carburetor mounted on the intake manifold. The intake manifold has an intake portion and exit portion opposite the intake portion and a portion defining at least one passage extending from the intake portion to the exit portion. The carburetor is mounted to the intake portion of the intake manifold and the carburetor provides a mixture of fuel and air into the intake manifold. The fuel economizer device includes a plate member mounted between the carburetor and intake portion of the intake manifold. The plate member has a portion defining at least one aperture. In addition, at least one tube is disposed through the at least one aperture in the plate member and extends longitudinally in the intake manifold from the intake portion toward the exit portion. The at least one tube further concentrates the mixture of fuel and air from the carburetor and conveys the mixture of fuel and air to a point adjacent but spaced away from the inlet port of the cylinder of the internal combustion engine.

It is therefore an object of the present invention to provide a fuel economizer device for use with carbureted internal combustion engines which reduces the fuel consumption of the internal combustion engine by concentrating the fuel/air mixture from the carburetor and conveying the concentrated mixture from a point adjacent but spaced away from the intake valve of each cylinder of the engine.

It is another object of the present invention to provide a fuel economizer device for use with carbureted internal combustion engines for reducing the fuel consumption of the engine by concentrating the fuel/air mixture from the carburetor and yet which is simple and inexpensive to make.

Other objects and advantages of the invention will become apparent from reading the following detailed description with reference to the drawings appended hereto.

DETAILED DESCRIPTION OF THE PREFERRED EMBODIMENT

Figure 1:
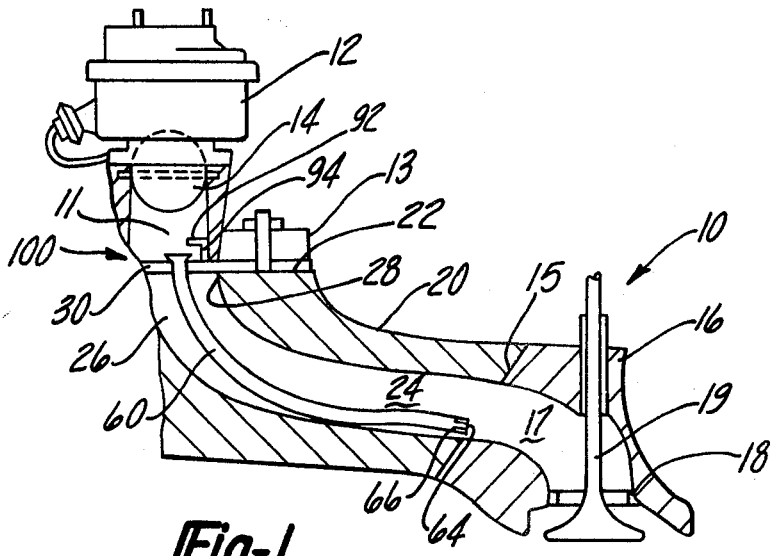
FIG. 1 is a partial sectional view of an otto cycle internal combustion engine with the device according to the present invention installed thereon.

Referring initially to FIG. 1, there is shown a conventional otto cycle internal combustion engine 10 having a conventional carburetor 12, a cylinder head 16 and a conventional intake manifold 20. The carburetor 12 includes a throttle plate 14 and a mounting base 13. The carburetor 12 may be a single barrel carburetor or a multi-barrel carburetor. In addition, the carburetor may have a single or multiple throttle plate.

Arranged in the cylinder head 16 are inlet passages 17 which communicate in the normal manner with the passages 24 in the intake manifold 20. The inlet passages 17 discharge into the combustion chamber of their respective cylinders. Arranged at each outlet 15 of the inlet passages in their respective cylinder heads 16, is a valve seat 18 for an inlet valve 19. The inlet valve is displacedly mounted in a valve guide arranged in the cylinder head. The passages 24 further communicate to an inlet plenum chamber 26 in the intake manifold. An intake portion 22 of the intake manifold has a throat 28 which communicates with the inlet plenum chamber 26.

Figure 2:
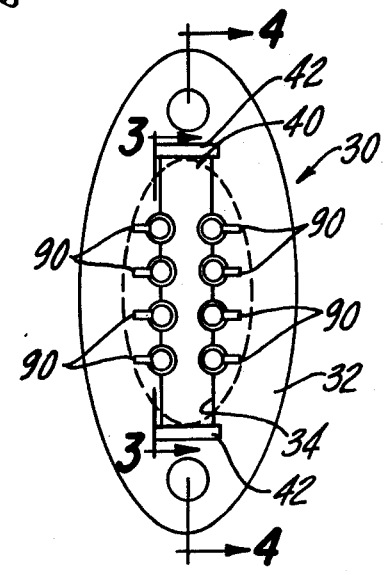
FIG. 2 is a top view of the fuel economizer device according to the present invention.

The fuel economizer device, according to the present invention, is generally designated by the numeral 100. The device 100 includes a plate member 30, tubes 60 and tube holding fingers 90 as shown in FIGS. 1 and 2.

Figure 3:
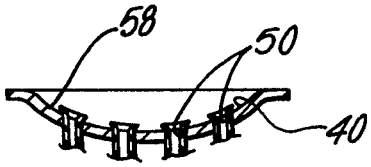
FIG. 3 is a sectional view along lines 3—3 of FIG. 2.
Figure 4:
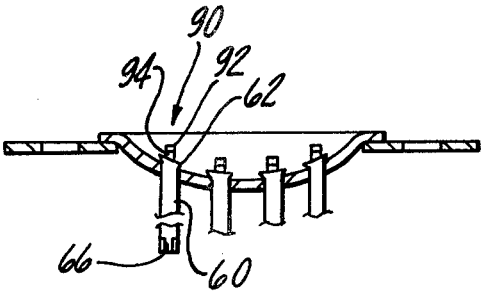
FIG. 4 is a sectional view along lines 4—4 of FIG. 2.

The plate member 30 is mounted on the top of the intake portion 22 of the intake manifold 20 so as to be mounted between the mounting base 13 of the carburetor 12 and the intake portion 22 of the intake manifold 20. The plate member 30 includes an outer portion 32 and an inner portion 40. The outer portion 32 has a shape which generally conforms to the shape of the mounting base 13 of the carburetor 12. The outer portion 32 of the plate member 30 and the mounting base 13 of the carburetor 12 are secured to the intake portion 22 of the intake manifold 20 by conventional screw fastener means or any other appropriate fastening method. The outer portion 32 also has an aperture 34 which is centrally located therein and is preferably rectangular in shape. The inner portion 40 of the plate member 30 is also preferably rectangular in shape and closely fits into the aperture 34 of the outer portion 32 of the plate member 30. In the alternative, any shape of the inner portion 40 and the aperture 34 may be used provided the inner portion 40 closely fits the selected shape of the aperture 34 so that the device 100 functions according to the teachings of the invention herein. The inner portion 40 also has a pair of legs 42 which are greater in diameter than the aperture 34. The legs 42 prevent the inner portion 40 from falling into the throat 28 of the intake manifold. A series of holes 50 are formed in the plate member 30 at the boundary between the inner portion 40 and the outer portion 32 for a purpose to be described later on herein as shown in FIGS. 2, 3 and 4. The holes 50 are further formed in the plate member 30 between an inner passage 11 of the carburetor 12 and the throat 28 of the intake manifold so as to be generally perpendicular to the passage 11. The plate member 30 is preferably dish shaped, as indicated at 58 away from the carburetor and toward the intake manifold to permit the conventional function of the throttle plates 14 in the passage 11 of the carburetor 12. In those situations where the throttle plates 14 do not rotate below the mounting base 13 of the carburetor, the plate member 30 need not be dish shaped as long as the function of the throttle plates 14 in the carburetor are not hampered.

Adjacent each hole 50 is mounted a tube holding finger 90 which is generally L-shaped so that one leg 92 extends above the hole 50. The other leg 94 is secured to the outer portion 32 so that each finger 90 extends away from the throat 28 and toward the passage 11 in the carburetor 12. The fingers 90 are also fastened on the plate member 30 by conventional fastening means such as soldering so as not to interfere with the function of the throttle plates 14.

Figure 5:
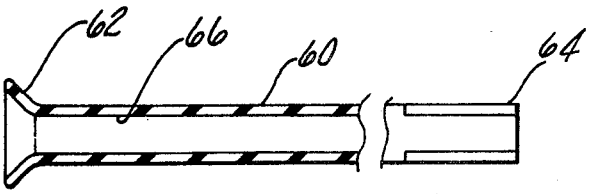
FIG. 5 is partial longitudinal sectional view of a tube.

The tubes 60 are generally elongated with internal passages 66 as shown in FIGS. 1 and 5. One end 62, of each of the tubes 60, is flared by conventional flaring tube methods. Thus, when each of the tubes 60 is inserted into one of the holes 50 in the plate member 30, the one end 62 is larger in diameter than the hole 50 and the tube is prevented from falling through the hole 50. The other end 64 of the tube extends longitudinally into one of the passages 24 of the intake manifold and may extend into the inlet passage 17 of the cylinder head 16. The other end 64 is located preferably three to four inches away from, and directed toward, the passage in the valve seat 18 of the intake valve 19. Thus, each of the tubes 60 is secured at its one end 62 by the plate member 30 and is bent slightly between the one end 62 and the other end 64 to allow the tube 60 to lie along a portion of its length in the passage 24 of the intake manifold 22.

The number of holes 50, and the number of tubes 60, required to practice the present invention depends on the number of cylinders in the internal combustion engine. Thus, for example, if the engine has a V-8 configuration, eight holes 50 would be formed in the plate member 30 and eight tubes 60 would be employed with one tube inserted into each of the holes. It is important in practicing the present invention that at least one tube be employed for each cylinder of the internal combustion engine. Preferably, one quarter inch outer diameter copper tubing is used in practicing the present invention.

The weight of the tubes 60 normally holds the one end 62 of the tube 60 to be secured in the holes 50 in the plate member 30. However, it is possible that the internal combustion engine may experience road shocks or some other sudden impact which may cause the tubes 60 to move the one end 62 away from the plate member 30. For this purpose, the tube holding fingers 90 are provided so as to maintain the one end 62 in the plate member 30 and to position the other end 64 to the aforementioned predetermined distance away from the inlet valve 19.

As described previously, during the suction stroke of the internal combustion engine, the intake valve opens to suck the fuel and air through the carburetor into the intake manifold and thence to the combustion chambers of the engine. The present invention modifies this function by causing the fuel/air mixture of the carburetor to be concentrated into and through the passages 66 of the tubes 60. In addition, the fuel/air mixture from the carburetor is then conveyed through the passages 66 of the tubes 60 to a point adjacent but spaced away from the intake valve 19 of each of the cylinders of the engine. Thus, the concentrated fuel/air mixture charge is injected into the combustion chamber of the internal combustion engine each time the intake valve opens to suck the fuel/air mixture from the carburetor. Because the fuel/air mixture is concentrated, the internal combustion engine is able to operate at a leaner overall fuel/air ratio than a conventional engine and thus reduce fuel comsumption of the internal combustion engine.

In order to remove one of the tubes 60 when the device 100 is installed on an internal combustion engine fitted with a carburetor, the carburetor 12 is first removed by unfastening the screw fastener means holding the carburetor 12 adjacent to the intake portion of the intake manifold. Next, the inner portion 40 of the plate member 30 is lifted out of the aperture 34 in the outer portion 32 in a direction away from the throat 28 of the intake manifold and at the same time twisted slightly so that the one portion of each of the holes 50 formed in the inner portion 40 clear the one end 62 of each of the tubes 60. With the inner portion 40 so removed, each of the tubes 60 may be removed or its position adjusted as required. When this operation is completed, the inner portion 40 is positioned in the aperture 34 of the outer portion 32 so as to trap the one end 62 of the tubes 60 as previously described.

It has been found helpful in practicing the described invention, that the conventional carburetor be provided with a manual choke so that during the cranking mode of the engine, a richer fuel/air mixture be provided to the engine. Once the engine has "started", the choke need no longer be engaged and thus the carburetor and the internal combustion engine will function as previously described.

While the invention has been described with reference to the above-described embodiment, it is understood that various modifications can be made to the above-described invention without departing from the scope of the invention. On the contrary, the invention is intended to encompass all such modifications as fall within the spirit and scope of the abovedescribed invention and the appended claims.

What is claimed is:

1. A fuel economizer device for use with an internal combustion engine, wherein said internal combustion engine has an inlet port, an intake manifold mounted adjacent said inlet port and a carburetor mounted on said intake manifold, said intake manifold having an intake portion, an exit portion opposite said intake portion and interconnected with said inlet port for fluid flow therebetween, and at least one passage in said intake manifold extending from said intake portion to said exit portion, said carburetor further being mounted adjacent to said intake portion, said carburetor further providing a mixture of fuel and air for flow into said internal combustion engine, said fuel economizer device comprising:

a stationary plate member interposed said carburetor and said intake portion of said intake manifold, said plate member having at least one aperture therethrough; and one tube disposed through said at least one aperture in said plate member and extending longitudinally in said passage of said intake manifold from said intake portion toward said exit portion, said tube further concentrating the mixture of fuel and air from said carburetor and conveying the mixture of fuel and air to a point adjacent but spaced away from said inlet port of said internal combustion engine.

2. A fuel economizer device as claimed in claim 1 wherein said tube further comprises a flared end and an opposite end, said flared end further being disposed in said at least one aperture in said stationary plate member adjacent said intake portion of said intake manifold.

3. A fuel economizer device as claimed in claim 1 further comprising:

means, connected to said stationary plate member, for holding said one tube to said plate such that said one tube is prevented from interfering with the operation of said carburetor and such that said one tube is held adjacent said intake portion of said intake manifold.

4. The fuel economizer device of claim 2 wherein said opposite end of said tube further is located a predetermined distance from said inlet port.

5. The fuel economizer device of claim 4 wherein said predetermined distance is between three and four inches from said inlet port.

6. The fuel economizer device of claim 2 wherein said opposite end of said tube is located adjacent but spaced away from said inlet port.

7. The fuel economizer device of claim 1 wherein said plate member further has an outer portion and an inner portion, said outer portion forming a seal between said stationary plate member and said intake manifold, said outer portion further having an aperture therethrough with said inner portion being generally disposed in said aperture, said outer portion further comprising means preventing said inner portion from passing through said aperture into said intake manifold.

8. The fuel economizer device of claim 3 wherein said holding means further comprises a tube holder member mounted adjacent said at least one aperture in said plate.

9. A fuel economizer device for use with an internal combustion engine, wherein said internal combustion engine has an inlet port, an intake manifold mounted adjacent said inlet port and a carburetor mounted on said intake manifold, said intake manifold having an intake portion, an exit portion opposite said intake portion and interconnected with said inlet port for fluid flow therebetween, and at least one passage extending from said intake portion to said exit portion, said carburetor further being mounted adjacent to said intake portion, said carburetor further providing a mixture of fuel and air for flow into said internal combustion engine, said fuel economizer device comprising:

a stationary plate member interposed said carburetor and said intake portion of said intake manifold, said plate member having at least one aperture therethrough;

means, disposed in said passage in said intake manifold and inserted in said aperture in said stationary plate member, for concentrating said mixture of fuel and air from said carburetor; and means, disposed in said passage in said intake manifold, for conveying said concentrated fuel air mixture a predetermined distance away from said exit portion of said intake manifold.

10. In combination with an internal combustion engine having at least one cylinder, said at least one cylinder having an intake port, said internal combustion engine further having an intake manifold mounted adjacent to said intake port of said at least one cylinder, said intake manifold having a top portion, a bottom portion opposite said top portion, and a portion defining at least one passage extending from said top portion to said bottom portion, said bottom portion being mounted adjacent said intake port of said at least one cylinder, said internal combustion engine further having a carburetor mounted adjacent to said top portion of said intake manifold, said carburetor being adapted for providing a fuel air mixture to said internal combustion engine, the improvement comprising:

a plate interposed said carburetor and said top portion of said intake manifold; and means, disposed in said at least one passage in said intake manifold, for concentrating said fuel air mixture from said carburetor a predetermined distance away from said intake port.

11. The fuel economizer device of claim 1 wherein said internal combustion engine has at least one additional inlet port and wherein said intake manifold has at least one additional passage interconnecting said intake portion with an additional exit portion opposite said intake portion and interconnected with said additional inlet port for fluid flow therebetween, said fuel economizer device further comprising:

at least one additional aperture through said plate member; and at least one additional tube disposed through said additional aperture and said plate member and extending longitudinally in said additional passage of said intake manifold from said intake portion towards said additional exit portion, said additional tube further concentrating the mixture of fuel and air from said carburetor and conveying the mixture of fuel and air to a point adjacent but spaced away from said additional inlet port of said internal combustion engine.

12. The fuel economizer device of claim 1 wherein said tube comprises the only passageway interconnecting said carburetor and said inlet port.

13. The fuel economizer device of claim 9 wherein said means disposed in said passage in said intake manifold and inserted in said aperture in said stationary plate member for concentrating said mixture of fuel and air from said carburetor comprises a tube inserted in said at least one aperture and extending therefrom into said passage.

14. The fuel economizer device of claim 9 wherein said means disposed in said passage in said intake manifold for conveying said concentrated fuel and air mixture to a predetermined distance away from said exit portion of said intake mainfold comprises a tube inserted in said at least one aperture and extending from said at least one aperture into said intake manifold passage to a predetermined distance away from said intake manifold.

15. The fuel economizer device of claim 14 wherein said tube further comprises a flared end and an opposite end, said flared end further being disposed in said at least one aperture in said stationary plate member adjacent said intake portion of said intake manifold.

16. The fuel economizer device of claim 14 further comprising:

means, connected to said plate member, for holding said tube to said stationary plate member such that said tube is prevented from interfering with the operation of said carburetor and such that said tube is held adjacent said intake portion of said intake manifold.

17. The fuel economizer device of claim 14 wherein said opposite end of said tube is located adjacent but spaced away from said inlet port.

18. The fuel economizer device of claim 14 wherein said stationary plate member further has an outer portion and an inner portion, said outer portion forming a seal between said stationary plate member and said intake manifold, said outer portion further having an aperture therethrough with said inner portion being generally disposed in said aperture, said outer portion further comprising means preventing said inner portion from passing through said aperture into said intake manifold.

19. The fuel economizer device of claim 14 wherein said holding means further comprises a tube holder member mounted adjacent said at least one aperture in said stationary plate member.

* * * * *